United States Patent [19]

Daniels

[11] Patent Number: 5,043,544

[45] Date of Patent: Aug. 27, 1991

[54] POWER TRANSMISSION ASSEMBLY

[75] Inventor: Nicholas R. Daniels, St. Louis, Mo.

[73] Assignee: Emerson Electric Co., St. Louis, Mo.

[21] Appl. No.: 575,396

[22] Filed: Aug. 29, 1990

Related U.S. Application Data

[63] Continuation of Ser. No. 362,074, Jun. 6, 1989, Pat. No. 4,972,053.

[51] Int. Cl.[5] ..... H01H 9/02; H01H 19/62

[52] U.S. Cl. ..... 200/30 R; 200/293

[58] Field of Search ..... 200/19 R, 26, 27 R, 200/27 B, 27 BA, 35 R, 38 R, 38 B, 38 C, 293, 30 R, 30 A, 31 R, 31 A

[56] References Cited

U.S. PATENT DOCUMENTS

| | | | |
|---|---|---|---|
| 2,633,519 | 3/1953 | Vance | 200/293 |
| 2,982,825 | 5/1961 | Johnson | 200/38 B X |
| 3,622,715 | 11/1971 | Jukes | 200/31 A X |
| 3,727,015 | 4/1973 | Voland et al. | 200/38 R |
| 3,846,597 | 11/1974 | Ziegler, Jr. | 200/31 R X |
| 4,406,932 | 9/1983 | Voland et al. | 200/38 B X |

*Primary Examiner*—J. R. Scott

*Attorney, Agent, or Firm*—Polster, Polster and Lucchesi

[57] ABSTRACT

Control apparatus for a power transmission assembly comprising a housing chamber having a switch member with connection leads and a switch actuating mechanism compactly disposed within the housing chamber with a barrier member between the connection leads and the switch actuating mechanism to prevent interference with the operation of the switch actuating mechanism.

5 Claims, 3 Drawing Sheets

POWER TRANSMISSION ASSEMBLY

This is a continuation of copending application Ser. No. 07/362,074, filed on June 6, 1989 now U.S. Pat. No. 4,972,503.

BACKGROUND OF THE INVENTION

The present invention relates to power transmission assemblies and more particularly to new and useful control apparatus included in power transmission assemblies adapted to move select parts of hospital beds.

It is generally known in the power assembly art to combine an assembly arrangement which includes a motor drive and a moveable parts actuator with a gear train therebetween, the assembly arrangement further including control apparatus for the assembly motor drive, such control apparatus being composed of a housing incorporating a switch and a switch actuating mechanism. The general power assembly arrangement aforedescribed has been employed to move several parts of a hospital bed, for example, to raise and lower the head of a bed relative the foot or vice versa or to raise or lower a bed frame—a wand switch connected to the control apparatus of the power transmission assembly for accomplishing such functions often being available to the hospitalized patient if the nature of a patient's illness so permits. The present invention recognizes that the control apparatus for such power transmission assemblies have given rise to occasional problems, particularly in situations where the control apparatus has been "blind assembled" in a single enclosed walled housing chamber which chamber is desirably compact in weight and size but yet must contain connection leads, a switch connected to the motor drive and to a patient user's wand and a switch actuating mechanism connected to the gear train between motor drive and the parts actuator. Specifically, the present invention recognizes that jamming and misoperation can occur among the several parts when they are "blindly assembled" in the compact enclosure.

Recognizing this bothersome and possibly costly problem, the present invention provides a unique, compact control apparatus for a power transmission assembly which is straightforward and economical to manufacture and assemble, which is light in weight and which avoids the jamming problems which might otherwise occur in "blind assembly".

Various other features of the present invention will become obvious to one skilled in the art upon reading the disclosure set forth hereinafter.

SUMMARY OF THE INVENTION

More particularly, the present invention provides in a power transmission assembly including power drive means, driven parts actuator means and gear train means connecting said power drive means to said driven parts actuator means, control apparatus therefor comprising: an enclosed walled housing chamber means sized to compactly contain both a switch member for the power drive means and an associated switch actuating mechanism connected to the gear train means through the housing chamber means; a plurality of connection leads extending into the enclosed walled housing chamber to be connected to the switch member; and, a barrier means disposed within the housing chamber between the connection leads for the switch member and the switch actuating mechanism to prevent interference or jamming in the operation of the switch actuating mechanism. In addition, the present invention provides for connection of a manual wand to the control apparatus, a novel cast walled housing arrangement including an integral stepped wall serving as a barrier means with an integral peripheral wall and base wall structurally arranged for the preassembly of the connection leads and the rapid mounting to a power transmission assembly as a compact unit with a minimum of assembly steps.

It is to be understood that various changes can be made by one skilled in the art without departing from the scope or spirit of the present invention. For example, the barrier means wall and the peripheral wall can be of a different geometric configuration from that disclosed and the switch actuating mechanism can be of an integral construction as distinguished from the stacked, adjustably assembled cam disks disclosed.

BRIEF DESCRIPTION OF THE DRAWINGS

Referring to the drawings which discloses one advantageous embodiment of the present invention.

DESCRIPTION OF THE PREFERRED EMBODIMENT

Figure 1:
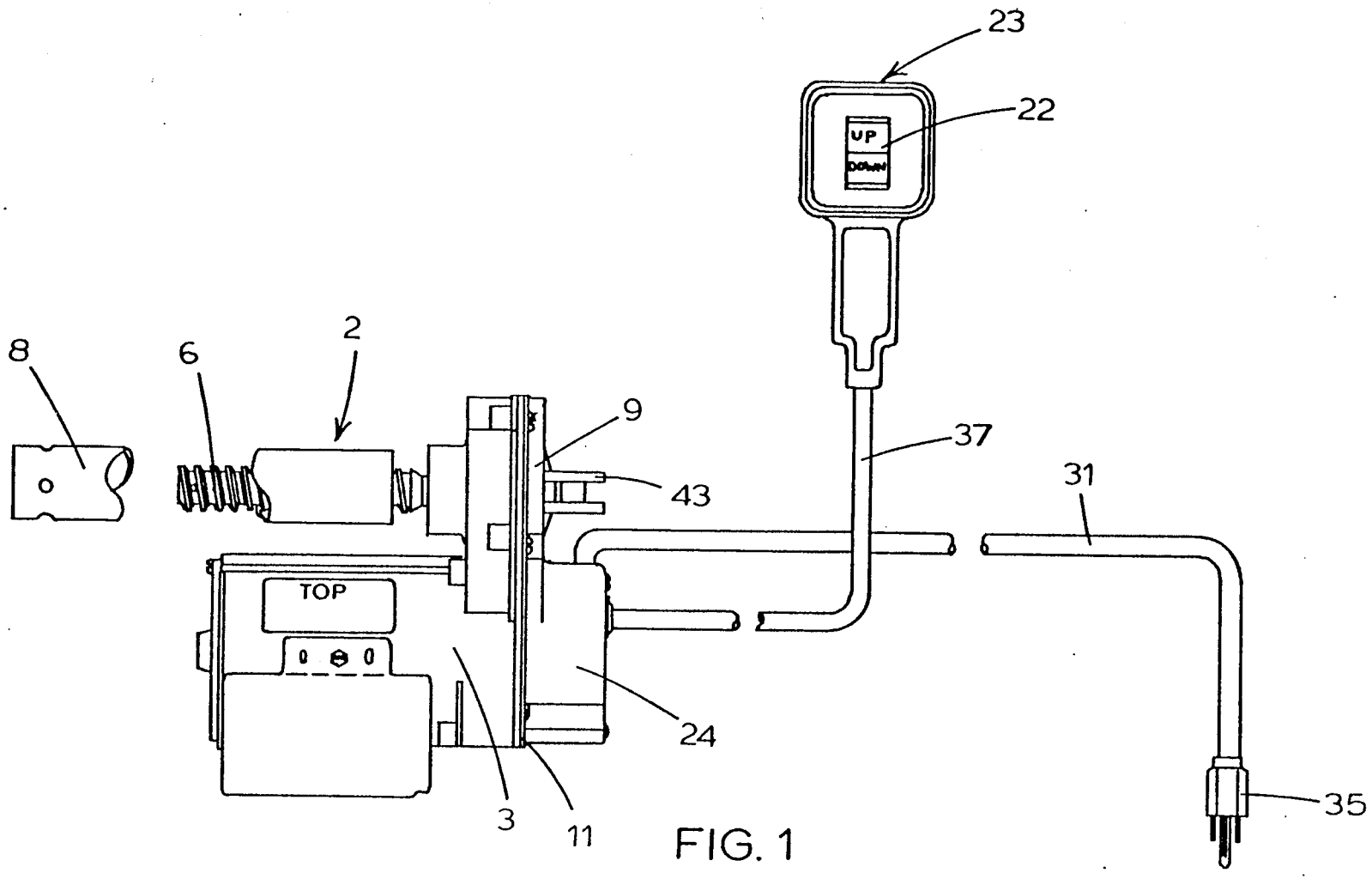
FIG. 1 is an overall front view of a power transmission assembly of the present invention adapted for use with preselected parts of a hospital bed including a motor drive, a driven parts actuator, a schematically represented gear train therebetween and the control apparatus of FIGS. 3 and 4 with a switch wand connected thereto.
Figure 2:
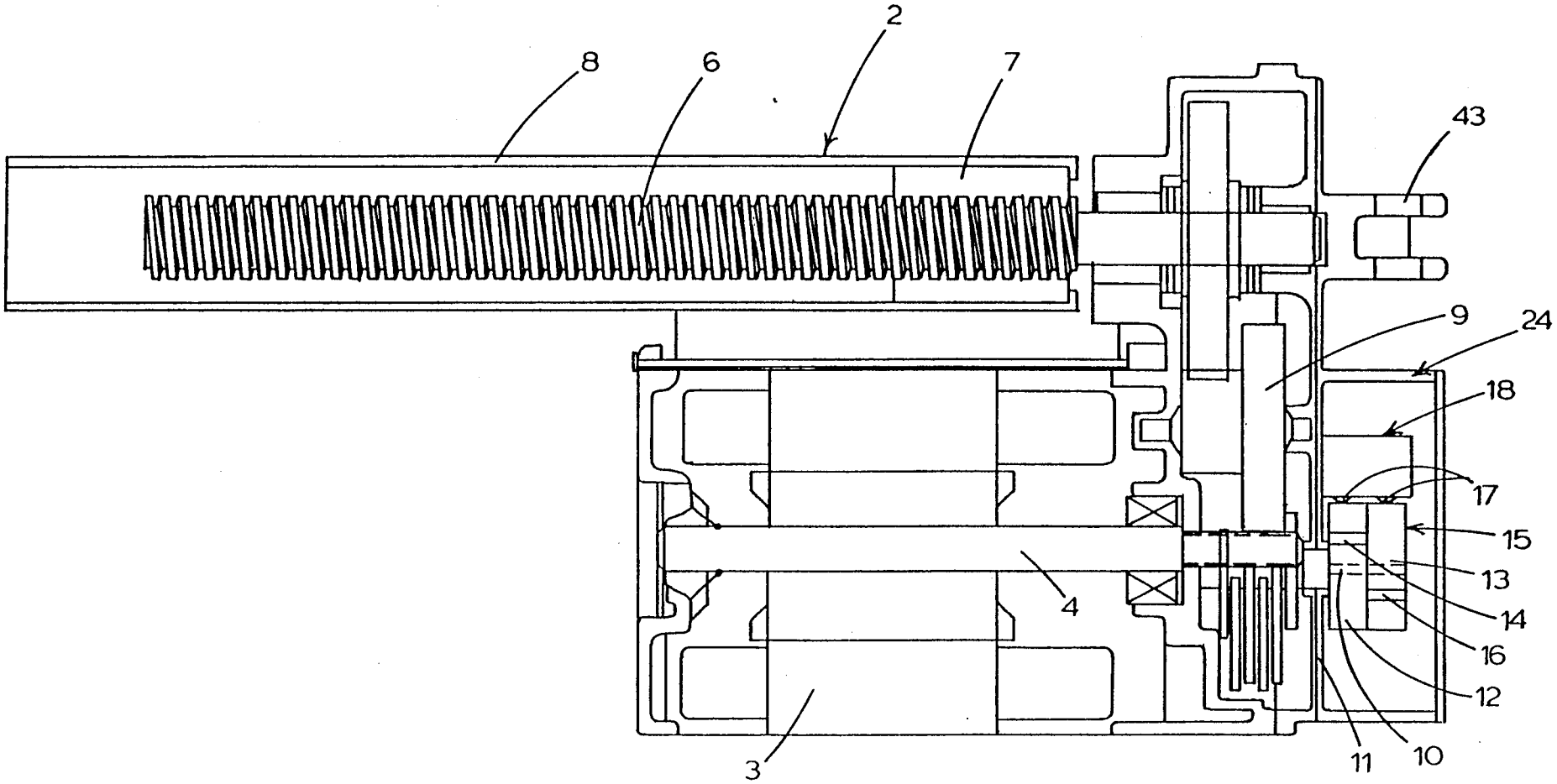
FIG. 2 is an enlarged cross-sectional view of the power transmission assembly of FIG. 1, further illustrating the manner in which the mechanical train of the assembly partially schematic for purpose of clarity is composed.

Referring to FIGS. 1 and 2 of the drawings, power transmission assembly 2 is disclosed as being suitable to drive preselected parts of a hospital bed (not shown). Power transmission assembly 2 includes an appropriately sized, reversible electric motor 3 having a drive shaft 4 (FIG. 2) extending therefrom connected to a drive screw shaft parts actuator 6 having a nut 7 mounted thereon which has fixed thereto the lineal movable parts actuating tubular shaft 8. A gear train or assembly 9, not described in detail but shown in FIG. 2 in partial schematic block form, is connected at one end to motor drive shaft 4 and at the other end to driven screw shaft 6. Drive shaft 4 is further connected through the reduced shaft portion 10 extending through base wall 11 to a pair of stacked or sandwiched lobed substantially circular cam disks 12 and 13 which are provided with peripherally staggered, raised lobes 14 and 16 (FIG. 3) which serve to respectively actuate one of two switch elements 17 spaced one above the other with only one being shown in the plan view of FIG. 3. The stacked, lobed cam disks 12 and 13 with their offset lobes 14 and 16 thus serve as a switch actuator 15 for the associated switch member 18 connected to electric motor 3 through leads 3'. It is to be understood that the stacked cam disks 12 and 13 can be separate to allow relative rotation thereof through cam disk fastening screws 19 extending through opposed arcuate slots 21 in the cam disk 13 to thus permit relative adjustment of the two disks 12 and 13 and their respective two lobes 14 and 16 about the rotational axis of the cam disks. It further is to be understood that the cam disks when held in fastened relation by screws 19 are rotated in one direction or the other in accordance with the position of the manually operative "Up" or "Down" switch 22 on manually operated wand 23 connected to the compact control assembly apparatus 24 which contains switch actuator 15 and switch member 18 aforedescribed.

Figure 3:
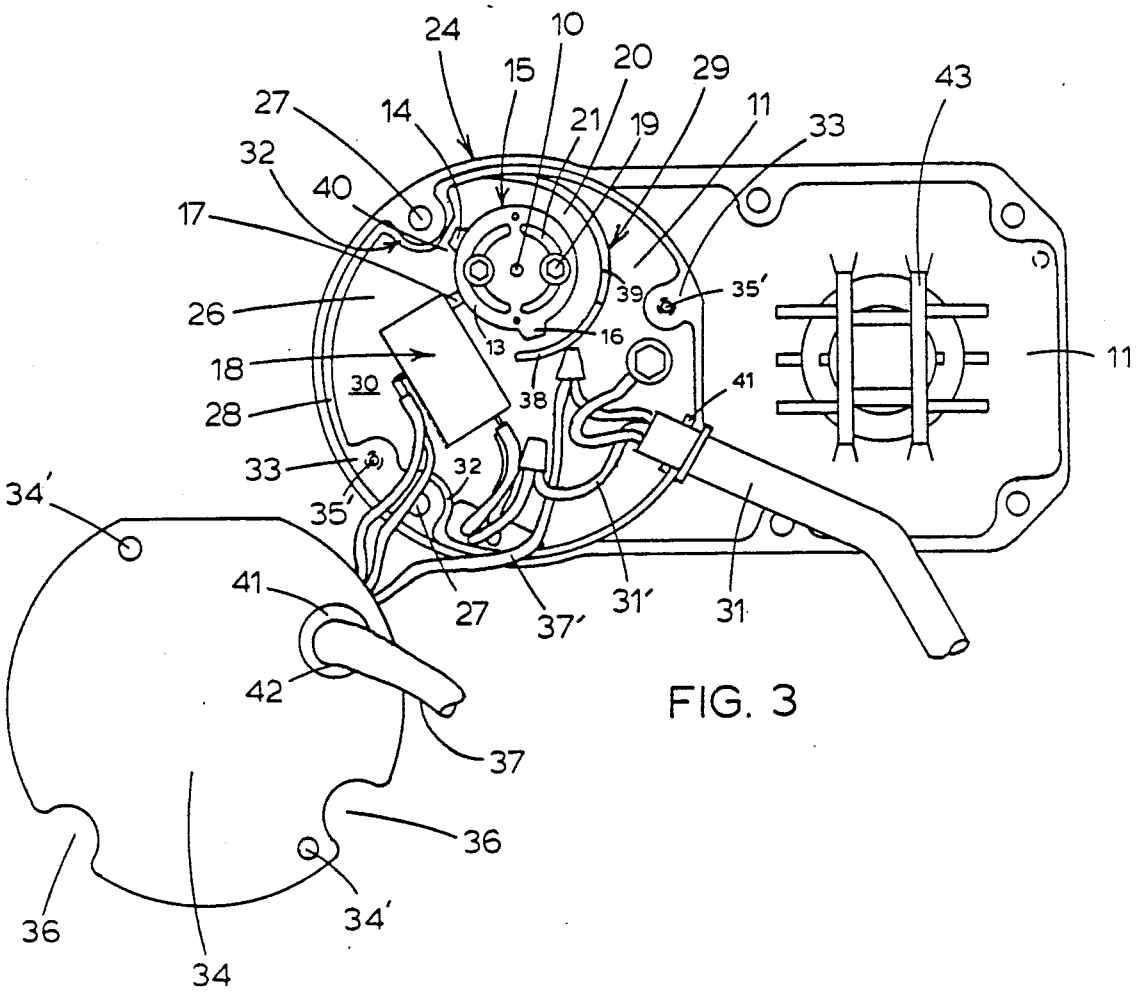
FIG. 3 is an enlarged broken away plan view of the novel control apparatus for mounting with the power transmission assembly of FIGS. 1 and 2 with the cover plate of FIG. 1A removed; and, FIG. 4 is an enlarged side view of the control apparatus of FIG. 3.
Figure 4:
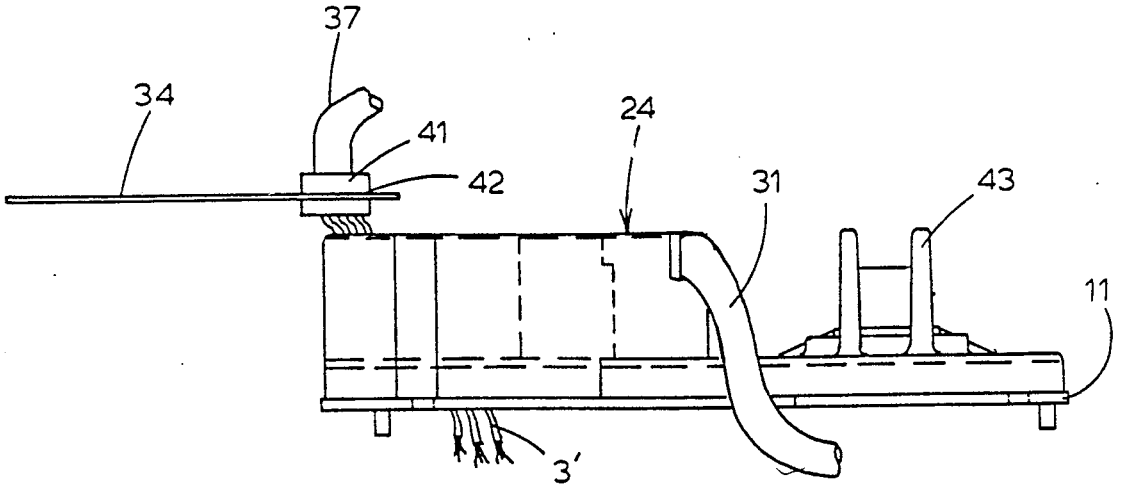

Referring to FIGS. 3 and 4 of the drawings, and particularly FIG. 3, it can be seen that control assembly apparatus 24 can be comprised of a compact, enclosed wall housing main chamber 26 which includes the integrally cast base wall member 11 having a plurality of mounting apertures 27 therein which extend in spaced relation around the periphery thereof. Integral with base wall 11 to extend normally therefrom is a peripheral, circular enclosing side wall member 28, which includes integral spaced post members 33 having apertures 35 therein, the base wall and side wall further including a curvilinear barrier wall 29 which also extends normally from the base wall 11 within peripheral side wall 28 with one end fixed to side wall 28. Barrier wall 29 serves to generally divide enclosed wall housing chamber 26 into two communicating subchambers 20 and 30 respectively which communicate with each other by passage 40 defined by the extremity of barrier wall 29 and the inner face of enclosing side wall 28 from which barrier wall 29 integrally extends into main chamber 26. The one chamber serves to receive stacked, lobed cam disks 12 and 13 which as aforedescribed are connected to one end of a reduced shaft 10 extending through base wall 11 with the other end of the shaft being connected to gear train or assembly 9 (FIG. 2) driven by motor shaft 4 (FIG. 2). The other subchamber 30 communicating with subchamber 20 through passage 40 serves to receive aforedescribed switch member 18 which is so positioned in the other subchamber 30 that switch elements 17 extend through passageway 40 to be associated with cam lobes 14 and 16 of respective cam disks 12 and 13. Also extending through the side wall 28 into the other subchamber 30 to be separated from cam disks 12 and 13 by curvilinear barrier wall 29 so as to not interfere or bind the operation of the cam disks 12 and 13 are a plurality of electrical connection leads 31' from conduit 31 for switch member 18, the conduit 31 leading to a power plug 35 (FIG. 1). It is to be noted that side wall 28 is provided with spaced, indented or recessed access portions 32 which are complimentary with and extend around mounting apertures 27 for external mounting of enclosed walled housing chamber 26 and that the second subchamber 30 includes as part of wall 28 integral post members 33 with apertures 35 therein to receive a thin, light cover plate on top 34. Cover plate 34 is provided with spaced peripheral apertures 34' therein for passage of fasteners to engage with the apertures 35' of post members 33 and is shaped to correspond with the shape of peripheral side wall 28 including recessed access portions 36 therein complimentary with recesses 32. A conduit 37 connected to wand 23 extends through conduit gripping grommets 41 surrounding an aperture 42 in cover plate 34 (FIG. 3) with its connection leads 37' extending into the second subchamber for switch connection. It is to be noted that base wall 11 also has mounted thereon the bracket member 43 which serves as a mounting bracket for the unit.

Finally, it is to be note that aforedescribed curvilinear barrier wall 29 which serves to divide the chamber 26 into separate communicating subchambers 20 and 30 respectively to protect the cam disks 12 and 13 from binding interference with the connection leads can be of stepped height to include higher and lower portions 38 and 39 respectively to reduce material usage and to minimize weight with the higher portion 38 being centrally disposed within chamber 26 with its upper edge supportively adjacent removable cover plate 34 and the lower portion 39 having its upper edge substantially in the same plane as the plane determining the upper face of the stacked cam disks 12 and 13.

Thus, a unique, compact power transmission assembly including a novel control apparatus is provided which is economical and straightforward in manufacture and assembly, which readily allows for appropriate cam adjustment and mounting and which avoids previous problems of wire pinching and of binding during "blind assembly."

The invention claimed is:

1. In a power transmission assembly including power drive means, driven parts actuator means and gear train means connecting said power drive means to said driven parts actuator means, control apparatus therefor comprising:

a substantially enclosed chamber having a first generally flat wall, a second generally flat wall, said second wall being substantially parallel to said first wall, and a transverse wall means extending between said first and said second walls;

a barrier wall within said chamber dividing said chamber into a first subchamber and a second subchamber with a connecting passage therebetween;

said first subchamber being smaller than said second subchamber;

a switch actuating mechanism in said first subchamber and being connected through one of said chamber walls to said gear train means;

a switch means in said second subchamber having a switch element communicating through said passage between said switch means and said switch actuating mechanism;

a plurality of connection leads entering said chamber from the exterior thereof into said second subchamber only and being prevented from interfering with said switch actuating mechanism in said first subchamber by said barrier wall; and at least some of said connection leads being connected to said switch means.

2. The power transmission assembly of claim 1 wherein said barrier wall is integrally formed with one of said first and second walls.

3. The power transmission assembly of claim 1 wherein at least one of said first and second walls is removably secured to said transverse wall means.

4. The power transmission assembly of claim 1 wherein said switch actuating mechanism includes curvilinear cam means mounted on a rotatable shaft connected through one of said first and second walls to said gear train means, and said barrier wall being curvilinear to at least partially surround said cam means so as to help minimize the size of said first subchamber and consequently help maximize the space in said second subchamber for facile placement of said connection leads and said switch means.

5. The power transmission assembly of claim 4 wherein said barrier wall includes a higher portion thereof which extends the entire distance between said first and second walls and a lower portion which extends only a portion of the distance between said first and second walls to minimize weight and reduce material usage.

* * * * *